United States Patent [19]

Brock et al.

[11] 4,261,077

[45] Apr. 14, 1981

[54] SASH LIFT

[75] Inventors: Roger L. Brock, Roscoe; Robert G. Penlesky, Rockford, both of Ill.

[73] Assignee: Amerock Corporation, Rockford, Ill.

[21] Appl. No.: 48,839

[22] Filed: Jun. 15, 1979

[51] Int. Cl.[3] ..... B25G 1/00

[52] U.S. Cl. ..... 16/126; 190/39; 190/58 R

[58] Field of Search ..... 16/126; 190/39, 58 R; 49/460

[56] References Cited

U.S. PATENT DOCUMENTS

| | | | |
|---|---|---|---|
| 235,299 | 12/1880 | Routh | 16/126 |
| 339,894 | 4/1886 | Jones | 16/126 |
| 2,548,163 | 4/1951 | Kaufmann | 16/126 X |
| 3,703,683 | 11/1972 | Ciepley | 16/126 |
| 3,769,655 | 11/1973 | Cartwright | 16/126 |

*Primary Examiner*—Andrew V. Kundrat

*Attorney, Agent, or Firm*—Leydig, Voit, Osann, Mayer & Holt, Ltd.

[57] ABSTRACT

A sash lift having a base which is adapted to be fastened to the bottom rail of a sash and a handle portion mounted on the base to turn relative to the latter from an inactive position to an active position. In the inactive position, the handle portion is parallel to the frame of the sash so that a plurality of sashes may be stacked for shipping in a comparatively small space and, when the sash is installed, the handle portion is turned to the active position in which it projects outwardly from the sash rail. Coacting surfaces on the handle portion and the base prevent the handle portion from turning beyond the active position and also from turning back toward the inactive position so that the handle portion is held rigidly in the active position for service use.

15 Claims, 10 Drawing Figures

SASH LIFT

BACKGROUND OF THE INVENTION

The present invention relates to a sash lift which is secured normally to the bottom rail of a sash and is gripped by hand to slide the sash up and down in a window frame. Basically, sash lifts include a base which is the part fastened to the bottom rail and a handle portion which projects from the base outwardly from the rail. Conventionally, sash lifts are cast or molded as a single unitary piece.

In many instances, window manufacturers will make the basic components of a window and attach the hardware to the components and the components are shipped as such to the place of installation. In the case of sashes, the sash lifts are attached to the sashes and then a number of sashes are stacked and shipped together. With conventional sash lifts, the handle portion projects a substantial distance out from the general plane of the sash and, as a result, there is a significant space between the sashes when they are stacked.

SUMMARY OF THE INVENTION

The general object of the present invention is to provide a novel sash lift in which the handle portion is movable relative to the base and originally in an inactive position generally parallel to the plane of the sash for shipping and in which, after the sash is installed, the handle portion is turned to and locked in an active position in which the handle portion projects outwardly from the sash for normal window operation.

A more detailed object is to form the base and handle portion as separate parts which are easily assembled with the handle portion in the inactive position and to make at least the base with resilient portions which yield as the handle is turned to the active position and then snap back so that coacting surfaces on the base and the handle portion engage each other and hold the handle portion in the active position.

The invention also resides in the novel details of the construction and arrangement of the base and handle portion.

DETAILED DESCRIPTION OF THE PREFERRED EMBODIMENT

Figure 2:
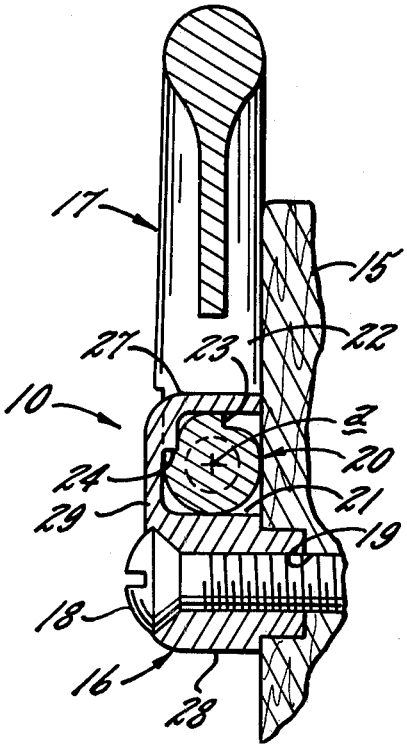
FIG. 2 is an enlarged fragmentary sectional view taken along the line 2—2 in FIG. 1.

As shown in the drawings for purposes of illustration, the invention is embodied in a sash lift 10 which is attached to a window sash 11 and is gripped to slide the sash up and down in a window frame 12 (FIGS. 2). Customarily, the sash is disposed in a vertical plane and comprises a transparent pane 13 mounted in the usual framework which is made up of stiles 14 at each side, a bottom rail 15 and a top rail (not shown). The sash lift includes a base 16 and a finger piece or handle 17 mounted on the base and the lift is secured to the bottom rail 15 by screws 18 which project through holes 19 (FIG. 4) in the case and are threaded into the rail.

Figure 1:
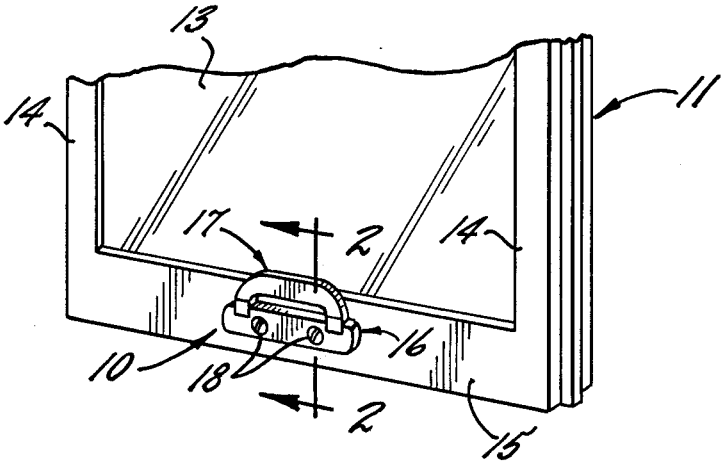
FIG. 1 is a fragmentary perspective view of a window sash with a sash lift constructed in accordance with the present invention and having the handle portion in the inactive position.
Figure 3:
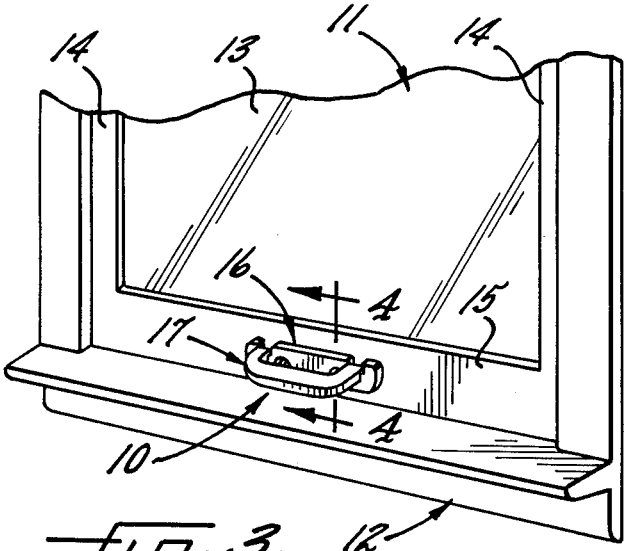
FIG. 3 is a fragmentary perspective view of a window with the sash mounted in place and with the handle portion of the sash lift in the active position.

In many instances, the manufacturer of the window attaches the hardware, including the sash lift 10, and ships the components thus partially assembled to the place of installation. In the case of the sashes 11, for example, a number of sashes are stacked and shipped together. With prior constructions, the handle 17 of the sash lift projects an appreciable distance out from the general plane of the sash with the result that there is considerable space between the stacked sashes and, thus, the presence of the lifts on the sashes reduces the number of sashes which can be stacked within a given space. The present invention contemplates the provision of a novel sash lift 10 with a handle 17 which initially is in an inactive position (FIG. 1) parallel to and close to the plane of the sash to reduce the space between stacked sashes and which, at the place of installation, is turned to the active position, the handle projecting outwardly from the sash in the normal manner when in the active position (see FIG. 3). The handle 17 and the base 16 of the sash lift coact so that, once the handle is swung to the active position, it is firmly locked in place and cannot be returned to the inactive position whereby the handle is fully effective in raising and lowering the sash.

Figure 5:
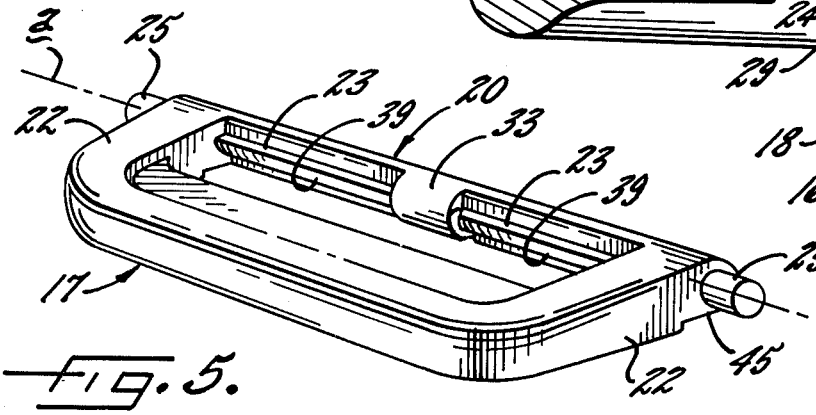
FIG. 5 is a perspective view of the handle portion of the sash lift.
Figure 6:
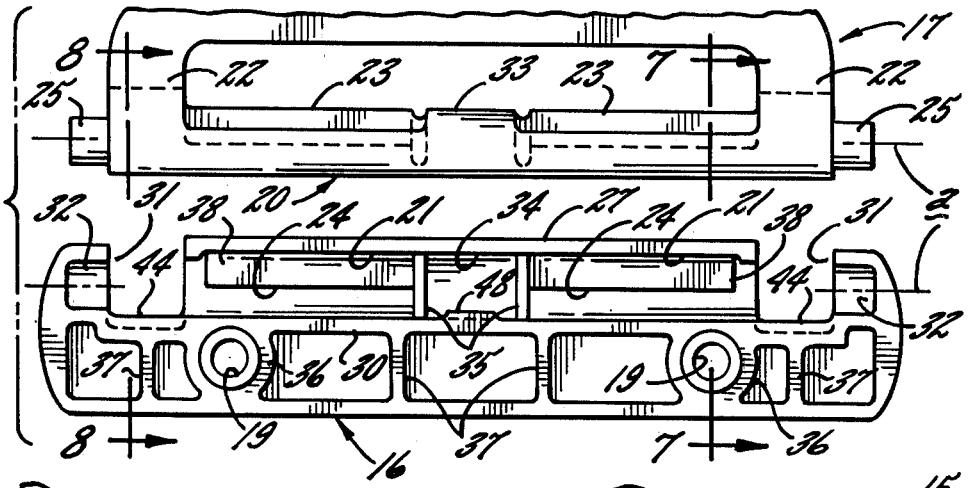
FIG. 6 is an exploded rear elevational view of the sash lift.

To achieve the foregoing, an elongated rod 20 (FIGS. 2 and 5) is disposed within a channel 21 (FIGS. 6 and 7) formed in the base 16 and extending horizontally or lengthwise of the base so that the rod may turn in the channel about an axis a which extends longitudinally of the rod. At least one leg 22 rigid with the handle 17 projects toward the base with the end of the leg being rigid with the rod 20 so that the rod and the leg support the handle for turning about the axis a from the inactive position to the active position. When the handle reaches the active position, a surface 23 on the rod engages a surface 24 on the base and prevents the rod and hence the handle from being turned back toward the active position whereby the handle than is effective for lifting the sash 11 in the frame 12. Preferably, the sash lift assembly also includes means to prevent the handle 17 from turning beyond the active position so that the handle is held rigidly in place for normal operation of the window.

In the present instance, there are two legs 22, one projecting from each end of the handle 17, and the handle, the legs and the rod 20 are molded as a single unitary piece of plastic material such as polycarbonate. The rod parallels and is spaced from the handles and spans the outer end portions of the legs (see FIG. 5) and cylindrical end portions 25 extend beyond the legs to serve as trunnions, the centers of the trunnions lying along the axis a. As shown most clearly in FIGS. 2 and 6, the base 16 is a hollow unitary piece molded from a plastic material such as polycarbonate and has top, bottom and front walls 27, 28 and 29 (FIG. 7) while being open at the back. The channel 21, which stops short of the ends of the base, is defined by the top wall 27 and the front wall 29 of the base and by a horizontal rib 30 in the base. The channel opens throughout its entire length through the back of the base to permit the rod 20 to be inserted in the channel. Slots 31 (FIG. 6) formed in the base communicate with the channel adjacent the ends thereof and open both upwardly and forwardly through the top wall 27 and the front 29 of the base to receive the legs 22 and to permit the legs to swing as the handle is turned from the inactive position to the active position.

The end portions 32 (FIG. 6) of the channel 21 are cyclindrical and receive the trunnions 25 to support the handle assembly for turning about the axis a. Additional support for such turning is provided by a cylindrical section 33 formed on the center portion of the rod 20 and received in a complementary shaped portion 34 of the channel 21. Partial webs 35 formed on the base 16 at opposite ends of the channel portion 34 abut the section 33 of rod and prevent the rod and hence the handle 17 from shifting endwise relative to the base. Below the channel 21 and inwardly of the ends thereof, the base 16 is formed with internal bosses 36 which define the holes 19 for receiving the screws 18. The base also includes vertical webs 37 extending between the bottom wall 28 of the base and the rib 30 to give the base rigidity.

Herein, the surfaces 23 and 24 on the rod 20 and the base 16 for holding the handle 17 against turning back from the active to the inactive position extend throughout a substantial portion of the lengths of the rod and the channel 21 respectively. Thus, the surface 24 on the base is formed on the underside of an elongated abutment 38 (FIGS. 7 and 9) which projects into the channel 21 from the front wall 29 of the base and extends substantially the full length of the channel while being interrupted by the central cylindrical portion 34 of the channel. The surface 23 on the rod is formed on a lobe 39 extending along the rod between the legs 22 and interrupted by the cylindrical section 33. As viewed when the handle 17 is in the inactive position as illustrated in FIG. 2, the lobe has a cam surface 40 which starts adjacent the abutment 38 and its radial distance from the axis a gradually increases as the cam surface extends upwardly and around the axis through an angle of approximately 90 degrees. The surface 23 is formed at the high end of the lobe 39 and is generally parallel to a radius of the rod 20.

Figure 7:
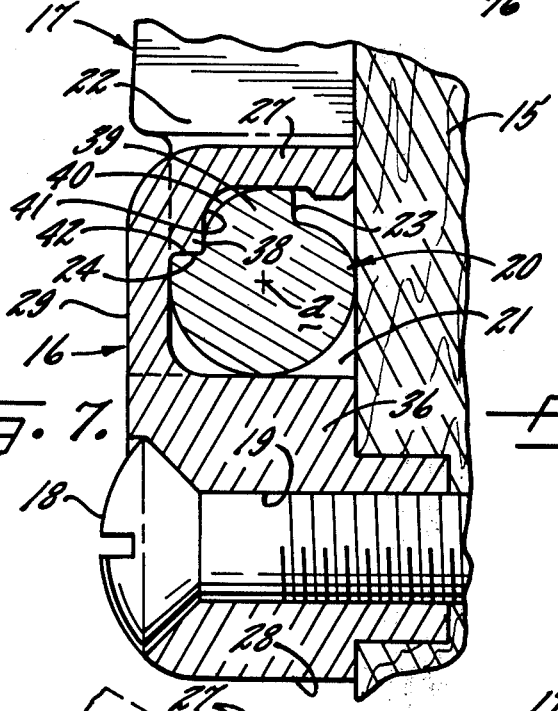
FIG. 7 is an enlarged fragmentary sectional view taken along the line 7—7 in FIG. 6.

When the handle 17, the legs 22 and the rod 20 are in the inactive position, the low end of the cam surface 40 bears against the vertical side 41 of the abutment 38 as illustrated in FIG. 7. As the handle is swung down from the inactive position toward the active position, the cam surface 40 bears against the side 41 (see the broken line position in FIG. 9) and, the material from which the base 16 is molded being resilient, progressively forces the abutment 38 outwardly until the lobe passes the abutment and the surface 23 on the lobe snaps in under the surface 24 on the abutment (see the solid line position in FIG. 9). The rod 20 may, as best shown in FIG. 7, have a second surface 42 similar to the surface 23 but disposed at the low end of the lobe 39 to engage the abutment surface 24 when the handle 17 is in the inactive position and prevent the handle turning into the rail 15 of the sash 11.

Figure 8:
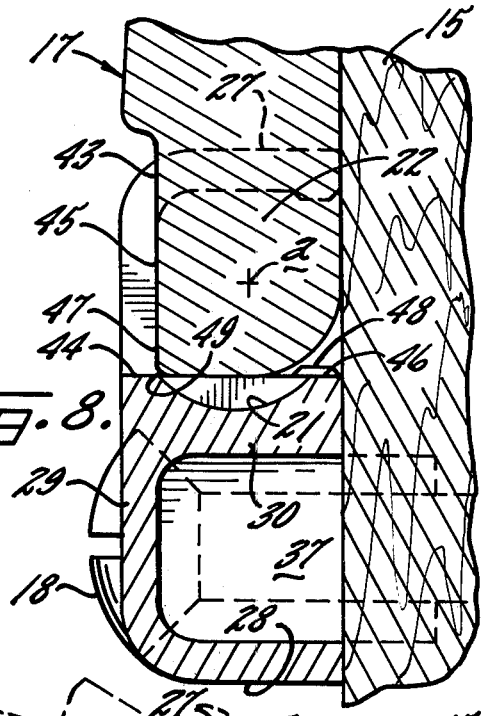
FIG. 8 is an enlarged fragmentary sectional view taken along the line 8—8 in FIG. 6.

As stated previously, it is preferred to incorporate means to prevent the hand 17 from swinging down beyond the active position. Herein, this means comprises surfaces 43 (FIG. 10) which are formed on the legs 22 and which face downwardly when the handle is in the active position and surfaces 44 which are formed on the base 16 and which face upwardly to be engaged by the surfaces 43 as shown in full lines in FIG. 10. The surfaces 43 are portions of flat areas 45 which are formed on the legs 22 and which face outwardly when the handle is in the inactive position (FIG. 8) and downwardly when the handle is in the active position. The surfaces 44 are formed on front wall 29 of the base in front of the channel 21 and define the bottom edges of the slots 31. Behind the channel on the upper side of the horizontal rib 30 are additional flat surfaces 46 which are even with the surfaces 44 and are engaged by the outer end portions 47 of the flat areas 45 on the legs 22 as illustrated in solid lines in FIG.10. Engagement of the protions 46 and 47 supplement the cooperation of the surfaces 23 and 24 in preventing the handle 17 from turning back toward the inactive position and, thus, the handle is locked firmly in the active position for service use.

With the foregoing arrangement, the handle assembly including the handle 17, the legs 22 and the rod 20 are molded as one piece and the base 16 is molded as a second piece. The two pieces are assembled by inserting the rod through the open back of the base and into the channel 21 with the handle and the legs oriented in the inactive position. During this insertion, the cylindrical central section 33 snaps over a small lip 48 (FIGS. 6 and 8) which projects upwardly from the back edge of the horizontal rib 30 and which holds the rod in the channel. The sash lift then is secured by the screws 18 to the bottom rail 15 of the sash 11 for shipping. Until such time as the sash is installed and the handle is ready to be turned to the active position, the engagement of the surfaces 24 and 42 prevents the handle from turning toward the bottom rail and the engagement of the cam surface 40 with the side 41 of the abutment 38 minimizes the tendency of the handle to swing toward the active position.

Figure 4:
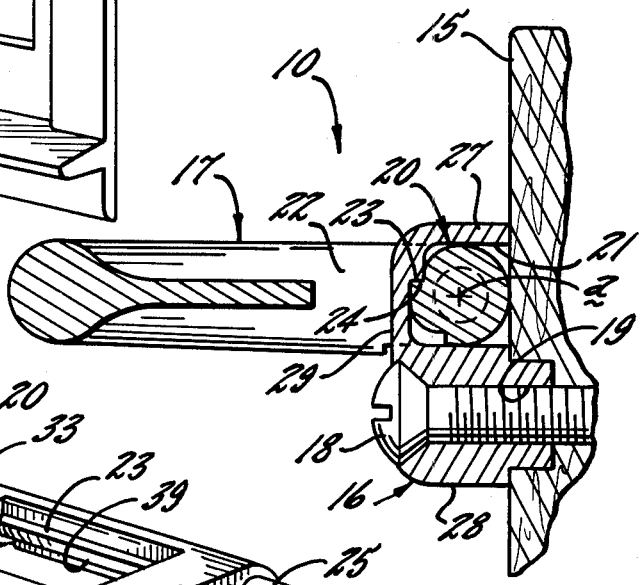
FIG. 4 is an enlarged fragmentary sectional view taken along the line 4—4 in FIG. 3.
Figure 9:
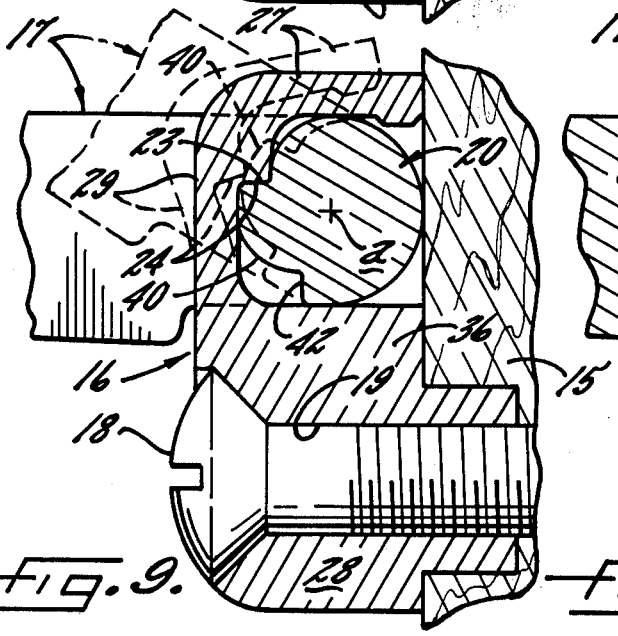
FIG. 9 is a view similar to FIG. 7 but with the parts in a moved position.
Figure 10:
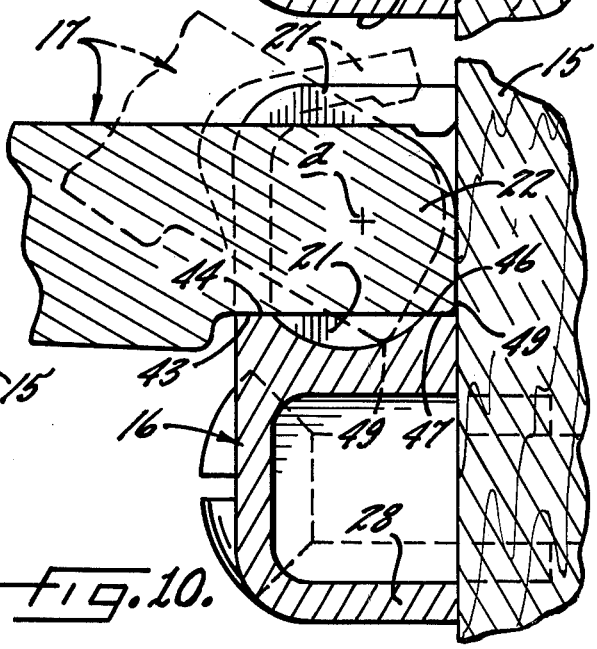
FIG. 10 is a view similar to FIG. 8 but with the parts in a moved position. along the line 8—8 in FIG. 6.

After the sash 11 has been installed in the window frame 12, the handle 17 is swung about the axis a from the inactive position (FIGS. 2, 7 and 8) to the active position (FIGS. 4, 9 and 10). During such turning, the cam surface 40 on the lobe 39 pushes the abutment 38 progressively outward as shown by the broken lines in FIG. 9. This shifting of the abutment is permitted by the resiliency of the base 16 and particularly of the upper half of the front wall 29. As the handle reaches the active position, the lobe 39 passes the abutment 38 which snaps back to its original position so that the surface 23 on the lobe engages the surface 24 on the abutment and prevents the handle from moving back toward the inactive position. At the same time, the surfaces 43 on the flat areas 45 of the legs 22 engage the surfaces 44 on the front wall 29 at the bottoms of the slots 31 and this prevents the handle from turning downwardly beyond the active position.

As illustrated in broken lines in FIG. 10, the resiliency of the base 16 also is utilized to bring the end portions 47 of the flat areas 45 on the legs 22 into engagement with the surfaces 46 on the horizontal rib 30. Thus, as the handle 17 with its legs 22 are turned toward the active position, the tips 49 of the legs engaged the bottom of the channel 21. Continued turning of the legs is permitted by the resilient upward bending of the top wall 27 which allows a slight upward shifting of the axis a and the legs as shown in FIG. 10. A similar shifting of the axis may also occur in the section of FIG. 9 but, for ease of illustration, the rod 20 has been shown as turning about a fixed axis. Depending upon the particular construction of the base 16, the rib 30 may also yield during such turning. In any event, the tip 49 thereby passes through the channel and the end portions 47 and surfaces 46 are brought into engagement to assist the surfaces 23 and 24 in preventing the handle from moving back toward the inactive position.

It will be observed that, with the construction described above, the sash life 10 may be mounted on the bottom rail 15 of the sash 11 with the handle 17 in an inactive position in which it is close to the rail and in a plane generally parallel to the plane of the sash. After the sash has been mounted in the window frame 12 and the handle has been turned to the active position, the handle is locked in this position with the result that, in service use, the rigidity of the sash lift is comparable to that of a conventional one-piece sash lift. At the same time, the sash lift 10 is made from two relatively inexpensive molded pieces which are easily assembled together.

We claim:

1. A sash lift for a window sash disposed in a predetermined plan and including a rail, said sash life comprising, an elongated base adapted to be mounted on said rail with the back side of the base against the rail, said base having an elongated channel extending lengthwise of the base, an elongated handle, at least one leg rigid with and projecting from said handle, an elongated rod generally parallel to said handle, said rod being rigid with the outer end of said leg and received in said channel to turn about an axis extending longitudinally of the rod whereby the rod with said handle and said leg form a handle portion supported for turning from an inactive position in which the leg is generally parallel to said plan and an active position in which said leg is substantially perpendicular to said plan, an abutment resiliently movable on said base, and a cam formed on said rod and operable as said handle portion is moved from said inactive position to said active position to move said abutment out of the path of the cam and permit the cam to pass the abutment, said abutment thereafter returning to a position behind said cam and preventing said handle portion from returning to said inactive position.

2. A sash lift as defined in claim 1 and having means including surfaces formed on said base and said handle portion and engaging each other when the handle portion is in said active position to prevent the handle portion from turning beyond the active position.

3. A sash lift as defined in claim 1 in which said channel opens throughout its length through the back of said base whereby said rod may be inserted into the channel through the back of the base.

4. A sash lift for a window sash disposed in a predetermined plane and including a rail, said sash lift comprising, an elongated base adapted to be mounted on said rail with the back side of the base against the rail, said base having an elongated channel extending lengthwise of the base and at least portions of the base around said channel being made of a resilient material, an abutment formed on said base to project into said channel and having a first stop surface thereon, an elongated handle, two spaced legs rigid with and projecting in the same direction from said handle, an elongated rod generally parallel to said handle and spanning said legs adjacent the outer end thereof, said rod being rigid with said legs and received in said channel to turn about an axis extending longitudinally of the rod whereby the rod supports said handle and said legs for turning from an inactive position in which the legs are generally parallel to said plane and an active position in which said legs are substantially perpendicular to said plane, and a lobe formed on said rod and having a cam surface with the radial distance from said axis gradually increasing from the low end of the cam surface to the high end, said lobe having a second stop surface extending inwardly from said high end of said cam surface, said low end of said cam surface engaging said abutment when said handle and said legs are in said inactive position and said cam surface resiliently moving said abutment away from said axis as the handle and legs are swung toward the active position until said first stop surface snaps back over said second stop surface, said stop surfaces abutting each other when said handle and said legs are in the active position to prevent the handle and the legs from turning back toward said inactive position.

5. A sash lift as defined in claim 4 in which said base is molded as a unitary piece of resilient plastic material and in which said handle, said legs and said rod are molded from a plastic material as a unitary handle portion which turns from said active position to said inactive position.

6. A sash lift as defined in claim 5 in which said rod has cylindrical end portions extending beyond said legs and serving as trunnions to support said handle portion for turning on said base.

7. A sash lift as defined in claim 6 in which the central portion of said rod is cylindrical to cooperate with said trunnions in supporting said handle portion for turning on said base.

8. A sash lift as defined in claim 7 in which spaced webs are formed on said base and project into said channel to engage opposite ends of said central portion and hold said rod against endwise shifting.

9. A sash lift as defined in claim 8 in which said lobe extends substantially the full lengths of the portions of the rod between each leg and the adjacent end of said central portion and the length of said abutment is substantially coextensive with the length of said lobe.

10. A sash life as defined in claim 9 in which said channel opens throughout its entire length through the back of said base to permit said rod to be inserted into said channel through the back of the base.

11. A sash lift as defined in claim 10 in which said base includes a lip adjacent the center and the back of said channel to engage said central portion and hold said rod in the channel, said lip resiliently yielding as the rod is inserted in the channel.

12. A sash lift as defined in claim 4 in which said lobe extends along a substantial part of the length of said rod and the length of said abutment is substantially coextensive with the length of said lobe.

13. A sash lift as defined in claim 4 including coacting surfaces on said legs and on said base with the surfaces on the legs engaging the surfaces on the base when said handle is in said active position to prevent the handle and the legs from turning beyond the active position.

14. A sash lift as defined in claim 13 in which the surfaces on said legs are formed by flat areas which are adjacent said rod and face outwardly when said handle is in said inactive position and the surfaces on said base are disposed alongside said channel.

15. A sash lift for a window sash disposed in a predetermined plane and including a rail, said sash lift comprising, an elongated base adapted to be mounted on said rail with the back side of the base against the rail, said base having an elongated channel extending lengthwise of the base and at least portions of the base around said channel being made of a resilient material, an abutment formed on said base to project into said channel abnd having a first stop surface thereon, an elongated handle, two spaced legs rigid with and projecting in the same direction from said handle, an elongated rod generally parallel to said handle and spanning said legs adjacent the outer end thereof, said rod being rigid with said legs and received in said channel to turn about an axis extending longitudinally of the rod whereby the rods supports said handle and said legs for turning from an inactive position in which the legs are generally parallel to said plane and an active position in which said legs are substantially perpendicular to said plane, said channel opening both upwardly and forwardly through the top and front sides of said base adjacent each end of the channel to receive said legs and permit the legs to turn from said inactive position to said active position, a lobe formed on said rod and having a cam surface with the radial distance from said axis gradually increasing from the low end of the cam surface to the high end, said lobe having a second stop surface extending inwardly from said high end of said cam surface, said low end of said cam surface engaging said abutment when said handle and said legs are in said inactive position and said cam surface resiliently moving said abutment away from said axis as the handle and legs are swung toward the active position until said first stop surface snaps back over said second stop surface, said stop surfaces abutting each other when said handle and said legs are in the active position to prevent the handle and the legs from turning back toward said inactive position, first flat surfaces formed on the outer end portions of said legs and facing away from said sash when said handle and said legs are in said inactive position, and second flat surfaces formed on said base adjacent the ends of said channel and engaged by said first flat surfaces when said handle and said legs are in said active position thereby to hold the handle and the legs in the active position.

* * * * *